US009064632B2

(12) United States Patent
Loiselle et al.

(10) Patent No.: US 9,064,632 B2
(45) Date of Patent: Jun. 23, 2015

(54) ROTATING POWER TRANSFORMER

(71) Applicants: Philippe Loiselle, Montreal (CA); Jurgen Scherber, Friedberg (DE); Nils Krumme, Feldafing (DE)

(72) Inventors: Philippe Loiselle, Montreal (CA); Jurgen Scherber, Friedberg (DE); Nils Krumme, Feldafing (DE)

(73) Assignee: Schleifring und Apparatebau GMBH (DE)

( * ) Notice: Subject to any disclaimer, the term of this patent is extended or adjusted under 35 U.S.C. 154(b) by 23 days.

(21) Appl. No.: 13/788,704

(22) Filed: Mar. 7, 2013

(65) Prior Publication Data

US 2013/0187740 A1 Jul. 25, 2013

Related U.S. Application Data

(63) Continuation of application No. PCT/EP2011/066009, filed on Sep. 15, 2011.

(30) Foreign Application Priority Data

Sep. 15, 2010 (DE) ..... 10 2010 040 848

(51) Int. Cl.

| | |
|---|---|
| ***H01F 21/06*** | (2006.01) |
| ***H01F 27/06*** | (2006.01) |
| ***H01F 27/02*** | (2006.01) |
| ***H01F 27/36*** | (2006.01) |
| ***H01F 21/04*** | (2006.01) |
| ***H01F 38/18*** | (2006.01) |

(52) U.S. Cl.

CPC ..... *H01F 38/18* (2013.01)

(58) Field of Classification Search

USPC ..... 336/65, 83, 84 C, 84 R, 115, 120, 121, 336/130–136

See application file for complete search history.

(56) References Cited

U.S. PATENT DOCUMENTS

| | | | | |
|---|---|---|---|---|
| 3,460,242 | A * | 8/1969 | Grad | 29/596 |
| 3,706,061 | A * | 12/1972 | Loika, Jr | 336/197 |
| 4,446,461 | A * | 5/1984 | Selleck | 340/870.32 |
| 4,741,217 | A * | 5/1988 | Morgan et al. | 73/862.339 |
| 6,388,548 | B1 * | 5/2002 | Saito et al. | 336/90 |
| 7,197,113 | B1 * | 3/2007 | Katcha et al. | 378/101 |
| 2007/0188284 | A1 * | 8/2007 | Dobbs | 336/120 |
| 2008/0204182 | A1 | 8/2008 | Simon et al. | |
| 2010/0225433 | A1 * | 9/2010 | Dunlap et al. | 336/197 |

FOREIGN PATENT DOCUMENTS

| | | | |
|---|---|---|---|
| FR | 2775383 | A1 | 8/1999 |
| JP | 05109540 | A * | 4/1993 |
| JP | 05190346 | A * | 7/1993 |

OTHER PUBLICATIONS

The International Search Report for International Application No. PCT/EP2011/066009 as mailed on Feb. 2, 2012.

* cited by examiner

*Primary Examiner* — Tsz Chan

(74) *Attorney, Agent, or Firm* — Yakov Sidorin; Quarles & Brady LLP

(57) ABSTRACT

Rotating power transformer having stationary and rotating parts. At least one of these parts includes a plurality of transformer segments preferably made of plastic material. Rectangularly shaped soft magnetic cores are held within the transformer segments together with at least one winding located in the soft magnetic cores, thereby facilitating simple and efficient assembly of the rotating power transformer.

8 Claims, 11 Drawing Sheets

ROTATING POWER TRANSFORMER

CROSS-REFERENCE TO RELATED APPLICATIONS

This application is a continuation of International Patent Application No. PCT/EP2011/066009 filed on Sep. 15, 2011, which designates the United States and, in turn, claims priority from German Patent Application No. 10 2010 040 848.4 filed on Sep. 15, 2010. The present application claims priority from and incorporates by reference each of the above-mentioned applications.

BACKGROUND

The invention relates to contactless rotary joints specifically for transfer of high levels of electrical power, also called rotating power transformers. Such contact-less rotary joints may be used in CT scanners.

A contactless rotary joint comprising an inductive power coupler is disclosed in U.S. Pat. No. 7,197,113 B1. Such a rotary joint is able to transfer power of more than hundred kilowatts from a stationary part to a rotating part. Rotary joints enabled to transfer such high levels of power have heavy iron- or ferrite-based cores for guiding the magnetic fields. For example, in a typical CT scanner, a free bore diameter of more than one meter is required. Accordingly, the inner diameter of a rotary joint configured for use with the CT scanner may be more than 1 meter, and the rotary joint would require large and massive mechanical support structures.

The European patent publication EP 1 481 407 B1 discloses a rotating transformer with a winding form made of a plurality of shaped parts held within a U-shaped ring.

SUMMARY

The embodiments of the present invention are directed to improve rotating power transformers by providing simplified mechanical design, increased robustness, the ability to withstand large centrifugal forces, and reliability while, at the same time, enabling the construction of such power transformers with decreased weight.

In a first embodiment, a rotating power transformer has a stationary part and a rotating part. When the rotating transformer is symmetrical, it may be preferred to have structurally similar stationary and rotating parts. Of course, these parts may differ to meet specific needs of the stationary or rotating parts, for example as far as the means for fixation of the parts to a machine is concerned. At least one of the stationary and rotating parts, and preferably both, are structured to have a ring-shaped body. Alternatively, the body may have the shape of a disk or a drum or, generally, a circular shape. It may also have different shapes adapted to the machine. The body is structured to provide stable support to the electric and magnetic components of the rotating power transformer. The body may be further supported by parts of a machine (such as a CT scanner, for example), into which the power transformer is integrated. The body may be made of metal such as aluminum or of plastic material, which preferably is further reinforced. It is preferred, however, to make the body from electrically isolating and non-magnetic material.

According to a first embodiment, a plurality of transformer segments of metal or a plastic material are provided. Each segment has at least one rectangularly shaped soft magnetic cores including ferrite or iron materials. Preferably, the soft magnetic cores are standard ferrite cores used for power transformers having a rectangular cross-section. The cores may be E-shaped or U-shaped cores. E-shaped cores are preferred, as they provide a better magnetic coupling and lower magnetic stray field. Each segment provides further means for holding at least one turn of at least one winding. Preferably, the transformer segments have means for holding the soft magnetic cores at predetermined positions. These transformer segments allow for simple assembly of the rotating transformer. First, the soft magnetic cores may be inserted into the transformer segments. Optionally the position of the soft magnetic cores is adjusted within the transformer segments. Then the transformer segments may be either attached to a body or a plurality of transformer segments are connected together to form the body. For the latter case, the transformer segments preferably have some minimum stability, which is required for the body. In the following step, the windings may be inserted into the transformer segments. After assembly of the winding, the transformer segment is cast to increase mechanical stability and electrical isolation. The transformer may include one or several windings each including one or several turns. In a preferred embodiment, a cover is provided, holding the windings in place. For terminating the windings and specifically for deflecting the direction of the windings out of the magnetic cores a termination segment may be provided. It is preferred that the soft magnetic cores be secured by glue, epoxy, or a similar material within the segments. It is further preferred that the segments hold at least two sets of soft magnetic cores and windings for dual power transmission, e.g. simultaneous transmission at two power channels. Even a higher number of channels may be realized. According to further modification of this embodiment, the transformer segments include at least two parts. The first part holds the soft magnetic cores, while the second part holds the windings. Both parts are assembled together to obtain the transformer segment.

In another embodiment, the body has a circular groove structured to hold the magnetic and electrical components of the transformer. Within the groove there are soft magnetic cores having a rectangular shape and including ferrite or iron materials. Preferably, the soft magnetic cores are standard ferrite cores used for power transformers having a rectangular cross-section. The cores may be E-shaped or U-shaped cores. E-shaped cores are preferred, as they provide a better magnetic coupling and lower magnetic stray field. To adapt the rectangular soft magnetic cores to the circular shape of the groove, wedge-shaped spacers are provided. Between every two soft magnetic cores, preferably one spacer is inserted. In this embodiment, the segments may include one soft magnetic core and a spacer. The spacers may also be formed or machined out of the material of the body.

At least one winding is provided in or on the soft magnetic cores, generating magnetic fields for coupling between stationary and rotating parts. Generally, a winding may include a plurality of wires, preferably litz wires. The winding is generally arranged within the circular groove and surrounded by the soft magnetic cores.

For mechanically terminating and electrically connecting the at least one winding, a termination module is provided. This termination module may provide electrical contacts to the windings or to the individual wires of the windings. It may furthermore deflect the windings or the wires thereof from their first direction parallel to the circular groove to an external connector. The termination module may also have means for interconnecting windings.

It is preferred that the winding do not fill the whole space within the soft magnetic core. The windings are preferably kept distant from the outer surfaces of the bars as magnetic stray fields (preferably occurring in air gaps between the soft magnetic cores) might penetrate the windings and cause electrical losses therein.

The soft magnetic cores may have at least one hole or groove, preferably under the center bar to affix the soft magnetic cores to the body. This hole or groove may be used to insert a screw or bolt from below or a bar at the body.

After assembling the rotating transformer, there may remain minor empty spaces or gaps within a soft magnetic core or between the neighbored soft magnetic cores, spacers and windings. There may also remain some empty space within the and the circular grove of the body. Preferably at least one of these empty spaces are cast or filled, preferably with a resin. This will improve mechanical stability and electrical isolation significantly.

A preferred method of manufacturing a rotating transformer includes the steps of providing a body with a circular groove, inserting soft magnetic cores with a rectangular cross-section and wedge shaped spacers between the soft magnetic cores into the groove, and casting and/or gluing of the soft magnetic cores and spacers into the groove of the body. Tools may be provided to hold the magnetic cores in predetermined positions until casting and/or glue-curing has finished. Such tools may be rings having indentations and/or protrusions to facilitate fixation of the soft magnetic cores. The tools may also have a shape-fitted to the soft magnetic cores. Preferably, the tools are designed to interact with the center bar of an E-shaped core as this usually has the smallest mechanical tolerances. Furthermore, the winding is inserted before or after the step of casting and/or gluing. In a final step a surface, preferably the surface of the soft magnetic cores may be machined to maintain a planar surface.

Another preferred method of manufacturing a rotating transformer includes the steps of providing a casting mold, inserting soft magnetic cores with a rectangular cross-section and wedge shaped spacers between the soft magnetic cores into the groove, and casting the soft magnetic cores and spacers. Furthermore, the winding is inserted before or after the step of casting and/or gluing. In a final step a surface, preferably the surface of the soft magnetic cores may be machined to maintain a planar surface. The resulting mold may then be inserted into a groove of a body or fixed to the surface of a body.

BRIEF DESCRIPTION OF THE DRAWINGS

In the following, embodiments of the invention are described in reference to examples, drawings, and without limitation of the general inventive concept.

Figure 1:
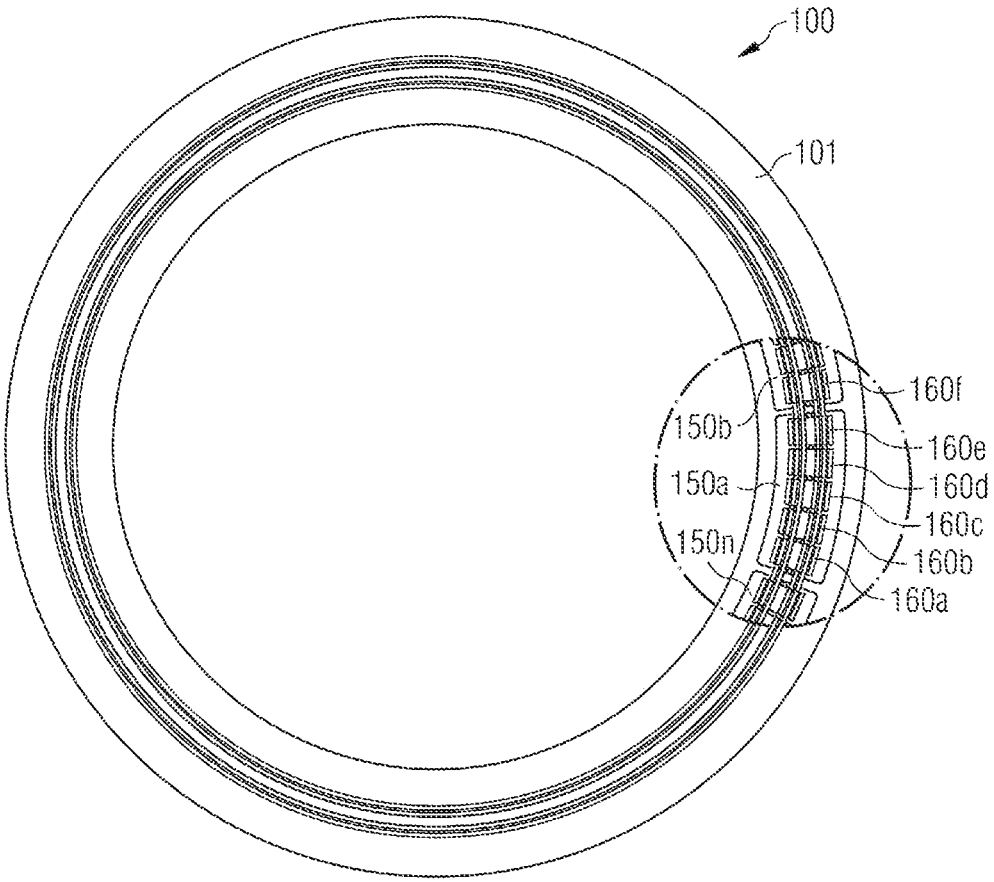
FIG. 1 is a top view of a part of two parts of the rotating transformer.

While embodiments of the invention can be appropriately modified, several of such embodiments are shown by way of example in the drawings and be described below in detail. It should be understood, however, that the drawings and detailed description are not intended to limit the invention to any particular form disclosed, but on the contrary, the intention is to cover all modifications, equivalents and alternatives falling within the spirit and scope of the present invention as defined by the appended claims.

DETAILED DESCRIPTION

An embodiment of FIG. 1 shows one of the two parts of the transformer. In general, a rotating transformer has two similar parts 100, one on the stationary side and the other on the rotating side. For simplicity, only one of these parts is described in detail. A plurality of transformer segments 150*a* . . . 150*n* is provided. These transformer segments may include of metal or plastic material. Due to its isolation characteristics a plastic material, preferably a fiber reinforced plastic material is preferred.

Figure 2:
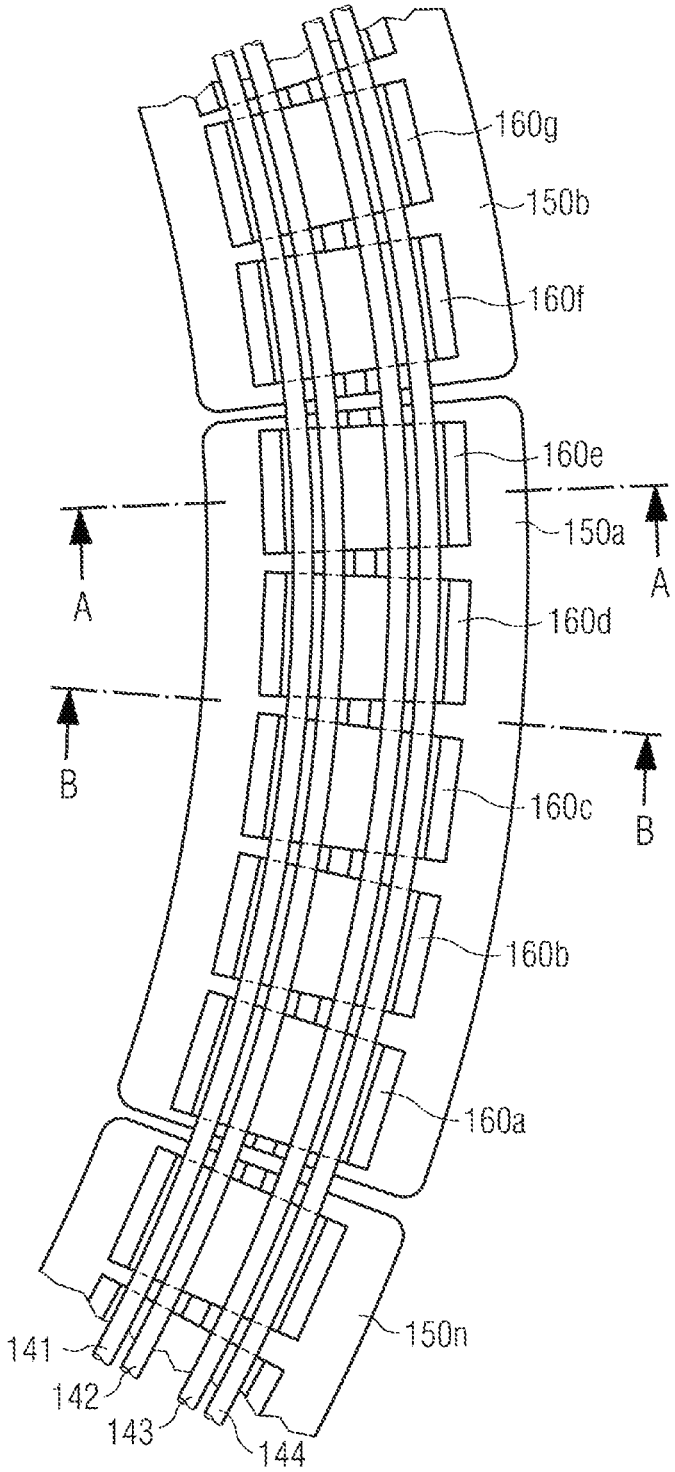
FIG. 2 is a partial view of a part of the transformer.

In FIG. 2, a section of the rotating transformer is shown in detail. Transformer segment 150*a* holds five soft magnetic cores 160*a* . . . 160*e*. Windings are located within the soft magnetic cores. The soft magnetic cores may be standard ferrite cores used for power transformers having a rectangular cross-section. The cores may be E-shaped or U-shaped cores. There may also be two U-shaped cores combined to form one E-shaped core.

Figure 3:
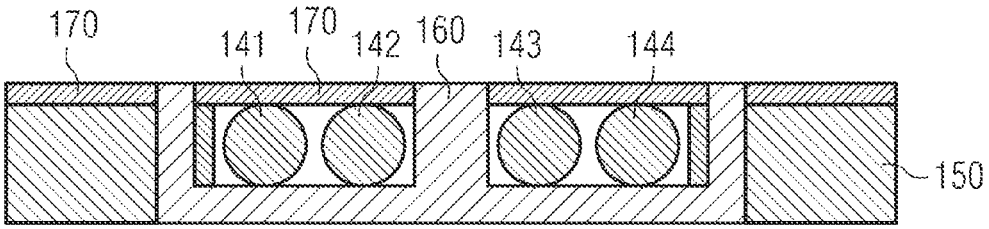
FIG. 3 is a first sectional view through a soft magnetic core.

In FIG. 3, a cross-sectional view (corresponding to the line A-A of FIG. 2) through a soft magnetic core is shown. The soft magnetic core 160 is held within transformer segment 150. Turns 141 and 142 of a first winding and turns 143 and 144 of the second winding are located within the soft magnetic core. A cover 170 holds the windings in place within the soft magnetic core.

Figure 4:
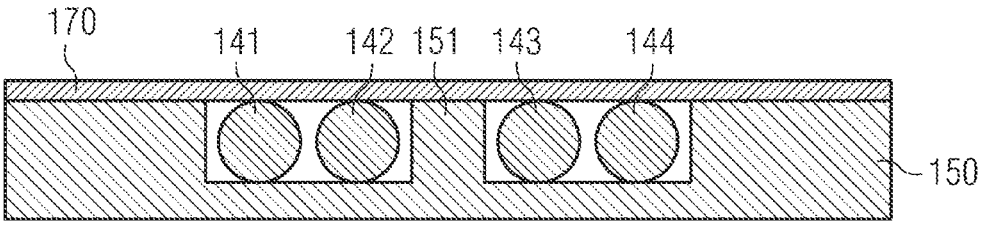
FIG. 4 is a second sectional view.

In FIG. 4, another cross-sectional view (corresponding to the line B-B through the body of transformer segment 150 of FIG. 3) is shown. Here, turns 141 and 142 of a first winding and turns 143 and 144 of the second winding are located within and held by the body of the transformer segment 150. Each transformer segment has a bar 151 similar to the center bar of a flat E-shaped ferrite core.

Figure 5:
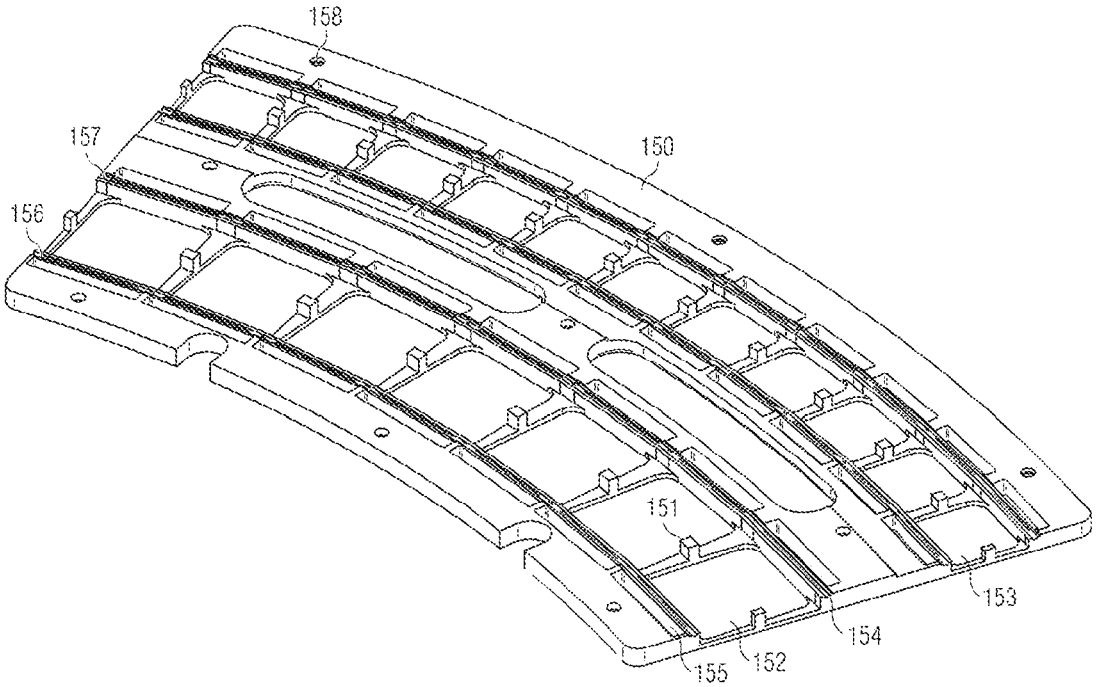
FIG. 5 is a perspective view of a transformer segment.

In FIG. 5, an embodiment of a transformer segment is shown. For clarity of illustration, the mechanical support structure, this transformer segment body 150 is shown without soft magnetic cores. This transformer segment is a dual transformer segment for the dual power transformer holding E-shaped flat ferrite cores with a rectangular cross-section. The soft magnetic cores of the first power transformer are located at an inner circle and held within first main openings 152. The soft magnetic cores of the second power transformer are located at an output circle and are held within second main openings 153. Preferably, there are small bars 151 for separating the windings. There are further openings 154, 155 for the sidebars of the ferrite cores. Furthermore, in this embodiment elastic elements 156, 157 preferably made of rubber are provided to hold the ferrite cores in place. Due to the friction caused by the elastic elements, the ferrite cores are held within the transformer segment and cannot fall out during assembly. Furthermore, they allow the ferrite cores small movements, which may be caused by magnetic fields, align themselves with opposing ferrite cores. This allows simple alignment during manufacturing. After the segments have been assembled, current may be fed through the magnetic cores causing them to align with opposing cores. Alignment may further be supported by rotation of two transformer parts against each other. Then the two transformer parts may be fixed to the position by means of glue or epoxy or a similar material.

Figure 6:
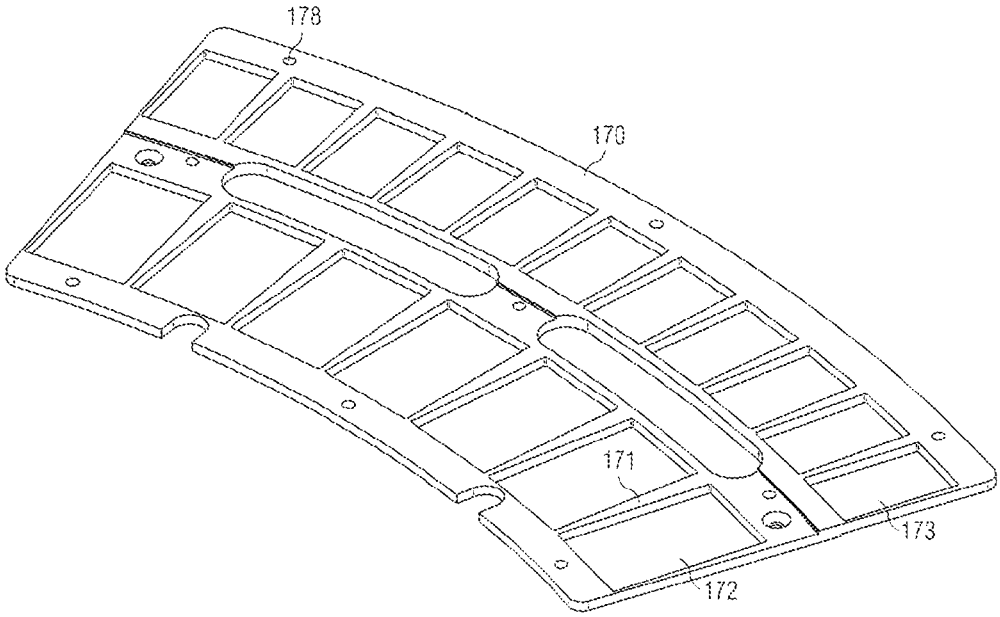
FIG. 6 is a perspective view of a segment cover.

In FIG. 6, an embodiment of a cover 170 is shown. This cover is fixed on the top of the transformer segment shown in the previous figure. The cover has first openings 172 for first soft magnetic cores and second openings 173 for second magnetic cores. There are bars 171 preferably located between the soft magnetic cores for holding the windings in place. Screw holes 178 are provided for fixing the cover 170 to the transformer segment body 150 by means of screws.

Figure 7:
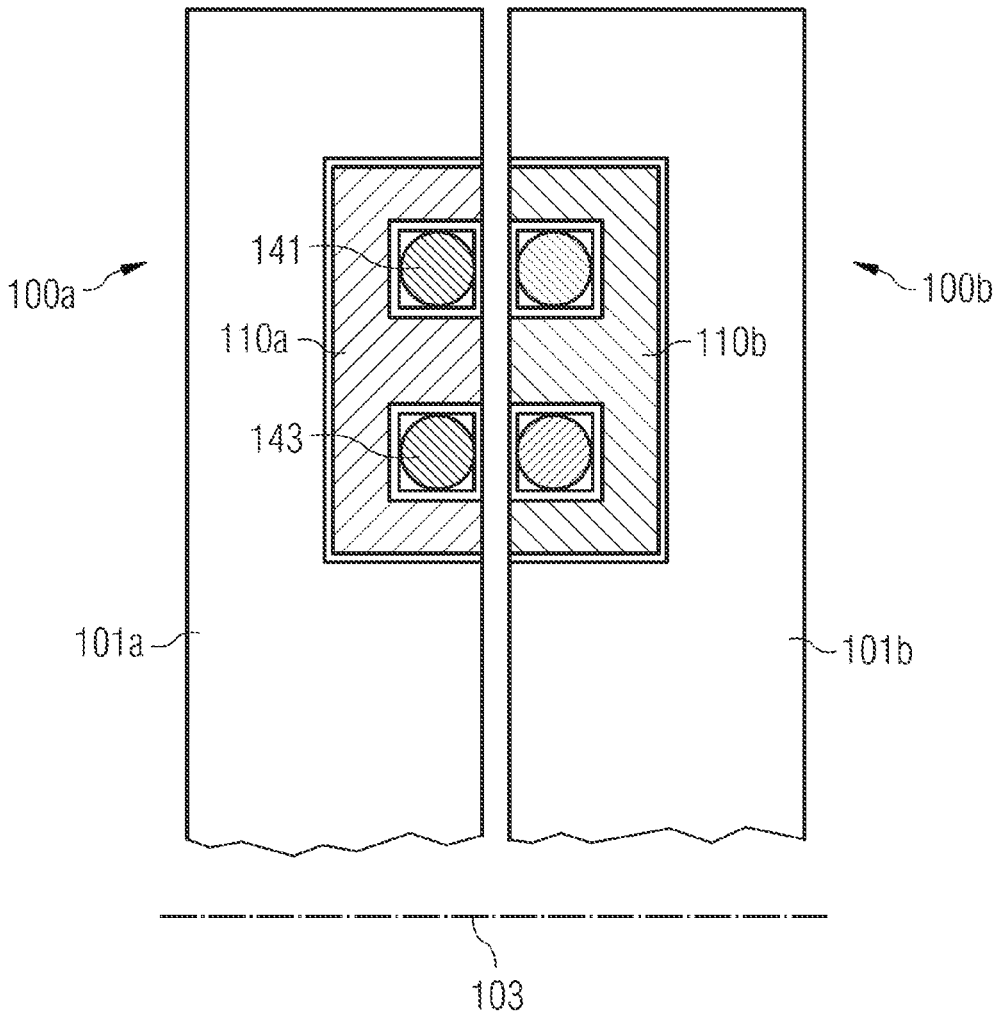
FIG. 7 is a schematic diagram of a rotating transformer.

In FIG. 7, a rotating transformer is shown in general. It has a first transformer part 100*a* on the stationary side and a second transformer part 100*b* on the rotating side, rotating around rotation axis 103. Both transformer parts may be very similar to each other or even substantially identical. Each transformer part has a body 101*a*, 101*b* and soft magnetic cores 110 with windings 141, 143 therein. Coupling between rotating and stationary side is achieved by coupling of magnetic fields of the windings.

Figure 8:
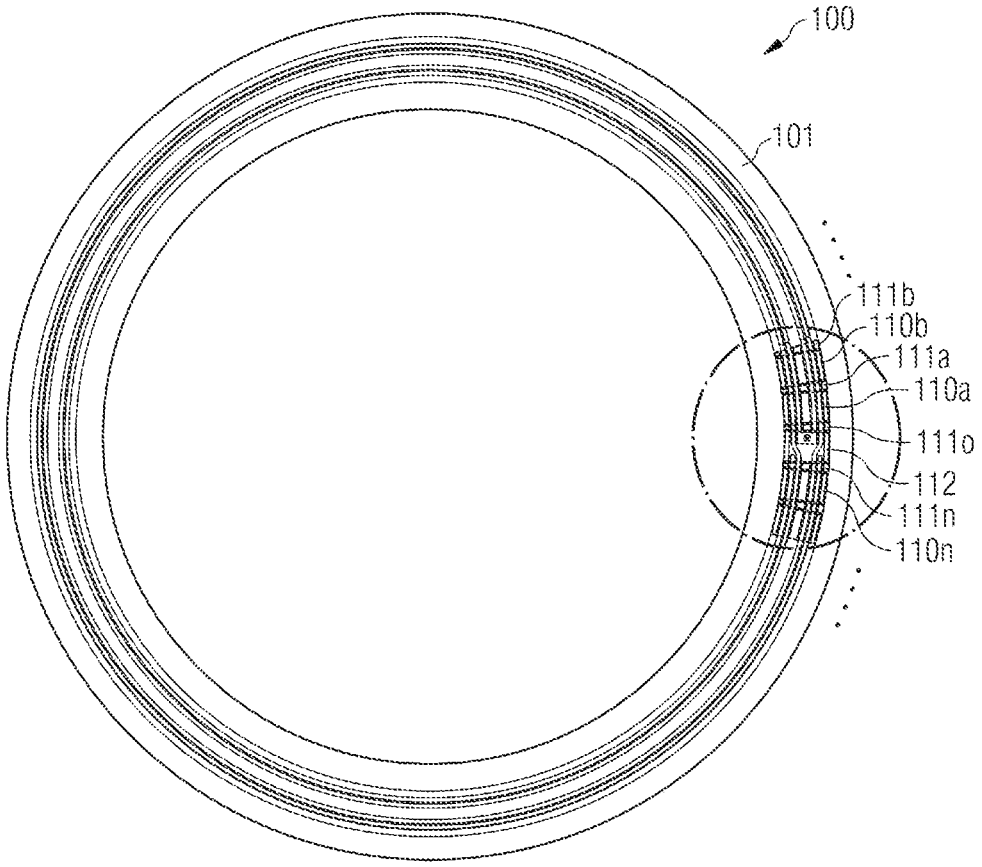
FIG. 8 is a top view of a part of two parts of the rotating transformer.

In FIG. 8, another embodiment is shown. It shows one of the two parts of the transformer. Generally, the transformer uses two similar parts 100. The transformer part has a body 101 holding a plurality of soft magnetic cores 110*a* . . . 110*n*. There are wedge shaped spacers 111*a* . . . 111*o*, between the individual magnetic cores. A termination module 112 is provided for terminating the windings.

Figure 9:
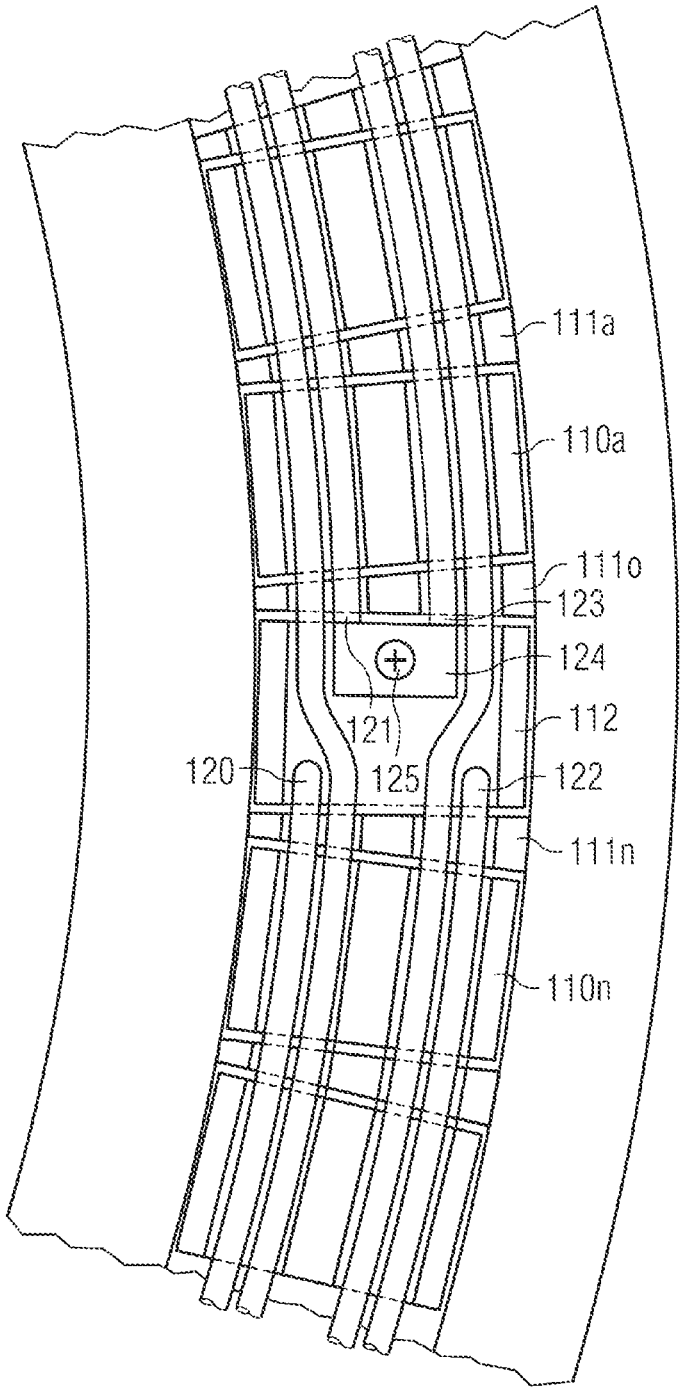
FIG. 9 is a top view of a termination module.

In FIG. 9 the termination module 112 and the section of the power transformer surrounding it are shown. The termination module preferably has a similar rectangular shape as the soft magnetic cores 110*a* . . . 110*n*. There may be also wedge shaped spacers 111*n* and 111*o* between the termination module and the neighboring soft magnetic cores 110*a* and 110*n*. In an alternative embodiment, the termination module may have a shape combining the neighboring wedges 111*n* and 111*o* into one piece. In this embodiment, the termination module has a terminating contact 124, preferably fixed by screw 125, to terminate and connect a second end 121 of a first winding and a second end 123 of a second winding. Furthermore, the termination module is provided for deviating the first end 120 of the first winding and the first end 122 of the second winding from that standard into a direction through the body 101 to the bottom of the body. The termination module increases electrical isolation and further limits the bending radii of the windings or the wires.

Figure 10:
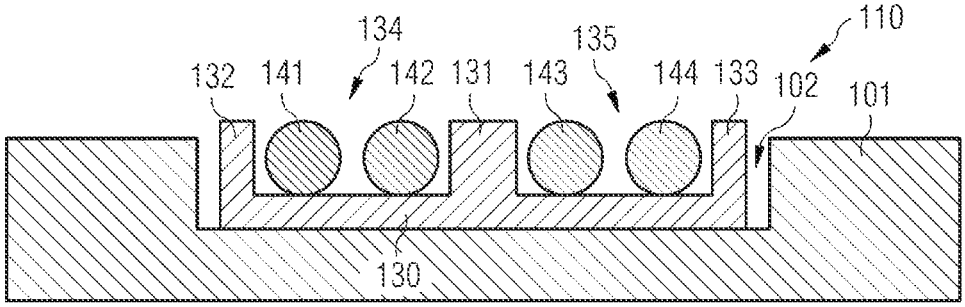
FIG. 10 is a sectional view of a transformer part.

In FIG. 10, a cross-sectional view of a transformer part is shown. The body 101 has a groove 102 holding a soft magnetic cores and spacers 111. The section of a transformer part resulting in this cross-sectional view is made through a soft magnetic core 110. The soft magnetic core has a base 130, a center bar 131 and a first and a second sidebar 132 and 133. Between the first sidebar 132 and the center bar 131 is first winding 134, including individual turns 141 and 142. While second winding 135 is between center bar 131 and second sidebar 133 including individual turns 143 and 144.

Figure 11:
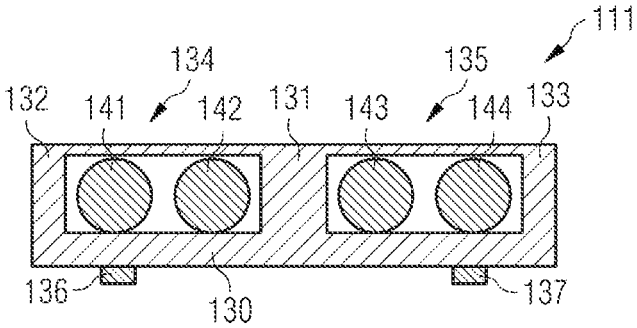
FIG. 11 is a sectional view of a further spacer.

In FIG. 11, a cross-section of a different spacer 111 is shown. In this embodiment, the spacer 111 encloses the individual turns of the windings to keep them in place. For this purpose, a locking bar is provided above the windings. This bar is configured to be removable to facilitate easy insertion of the windings during assembly. Furthermore, protrusions 136 and 137 are shown to improve fixing of the spacer within body 101, preferably by holes provided within the body. Although it is preferred, it is not necessary to provide protrusions or other means for improve fixing, when the spacer is made to enclose the windings.

Figure 12:
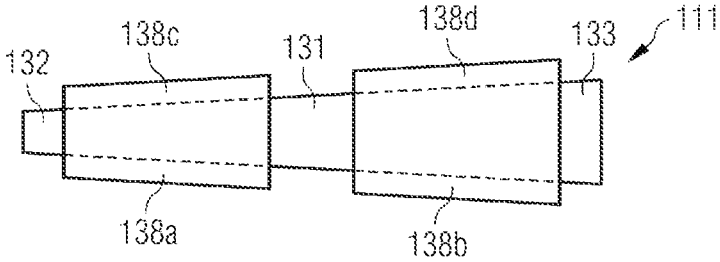
FIG. 12 is a top view of a spacer with fins for holding soft magnetic corer.

In FIG. 12, a further modification of a spacer 111 is shown in top view. This spacer has fins 138*a* . . . 138*d* to hold neighboring soft magnetic cores at their places. In general, a spacer may have means for holding neighboring soft magnetic cores into a predetermined position relative to the spacer.

Figure 13:
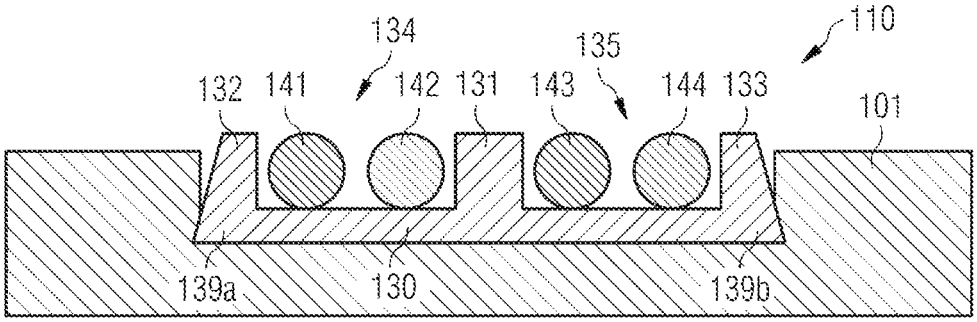
FIG. 13 is a sectional view through a further spacer.

In FIG. 13, a different embodiment of the core is shown. this embodiment has an extended base at corners 139*a* and 139*b*, which may be used to hold the core within an undercut section of the groove 102. Preferably, the soft magnetic core is glued or cemented into the groove.

Figure 14:
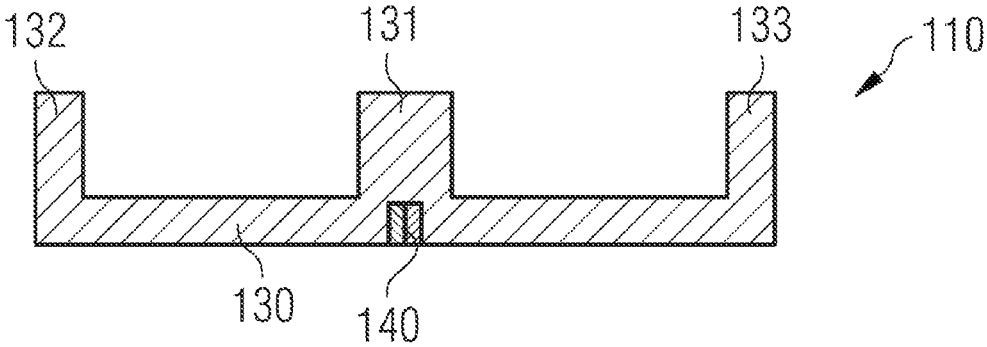
FIG. 14 is a sectional view of a modified soft magnetic core.

In FIG. 14, a modified soft magnetic core is shown. The magnetic core has a hole 140 for fixing it by a screw or bolt to the base 130, which preferably includes a flexible or at least vibration absorbing material. A spacer 111 may also have such a hole for fixing it by a screw or bolt to the base 130.

Figure 15:
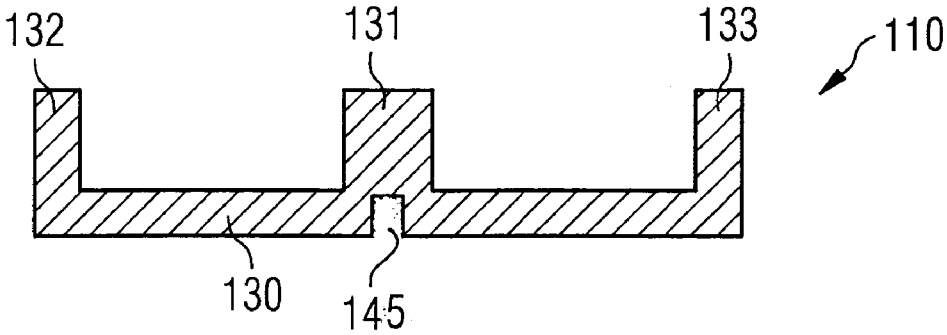
FIG. 15 is a sectional view of a modified soft magnetic core with a groove.

In FIG. 15, a modified soft magnetic core is shown. The magnetic core has a groove 145 structured to facilitate the affixation of the magnetic core by a screw and/or bolt to the base 130, which preferably includes a flexible or at least vibration absorbing material. The groove may be aligned by a bar or protrusion of the base. A spacer 111 may also have such a groove for fixing it by a screw or bolt to the base 130.

Figure 16:
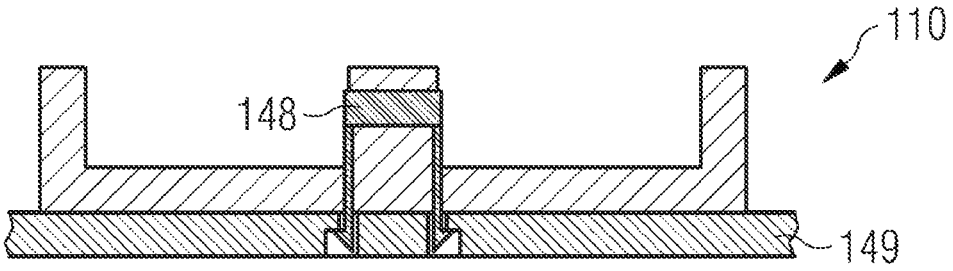
FIG. 16 is a side view of a soft magnetic core with a clamp.

In FIG. 16, a soft magnetic core is shown in a side view. The core is held by a clamp 148, which preferably encircles its center bar to a base plate 149. The base plate may be a plate attached to body 101. Alternatively, the clamp may be fixed to body 101. The clamp may have a latch. The soft magnetic core shown herein is a typical E-shaped core with rectangular cross-section as it may be used herein.

Figure 17:
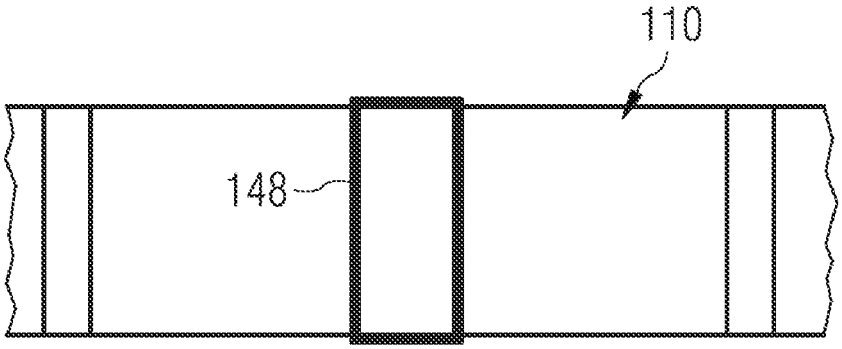
FIG. 17 is a top view of a soft magnetic core with a clamp.

In FIG. 17, the soft magnetic core of the previous figure is shown in a top view.

Figure 18:
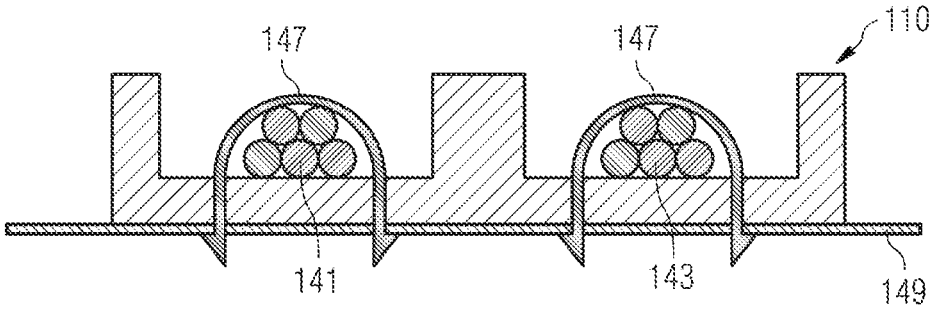
FIG. 18 is a sectional view showing windings held by clamps.

FIG. 18 shows the individual turns 141, 143 of windings held by clamps 147 to a base plate 149. The base plate may be a plate attached to body 101. Alternatively, the clamp may be fixed to body 101. The clamp may have a latch. Furthermore, the clamp may be glued, cemented or pressed into the base plate or body. The clamp may also be crafted together with the winding. Furthermore, it is preferred, if the clamp does not have sharp edges to prevent damage of the insulation of the windings.

Figure 19:
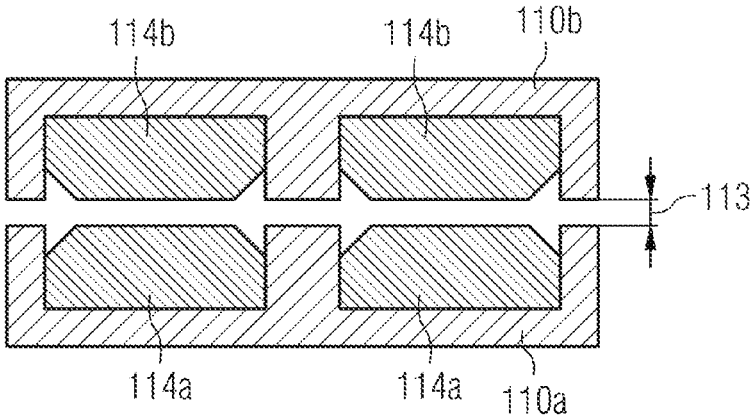
FIG. 19 is a sectional view showing the usable space for windings.

FIG. 19 shows the usable space for windings. A first soft magnetic core 110*a* which may be of the stationary part is opposed a second soft magnetic core 110*b* which may be of the rotating part. Due to mechanical tolerances, there is an air gap 113 between the soft magnetic cores. Around the air gap, there is a magnetic stray field, which may penetrate into the windings. Such that magnetic field within the winding may cause additional losses decreasing overall efficiency and possibly causing local overheating of the windings. To prevent penetrating of magnetic stray fields into the windings, it is preferred to have some distance between the windings and the air gaps. Preferably, the space available for windings 114*a* and 114*b* is chamfered to keep a minimum distance from the magnetic stray field.

Figure 20:
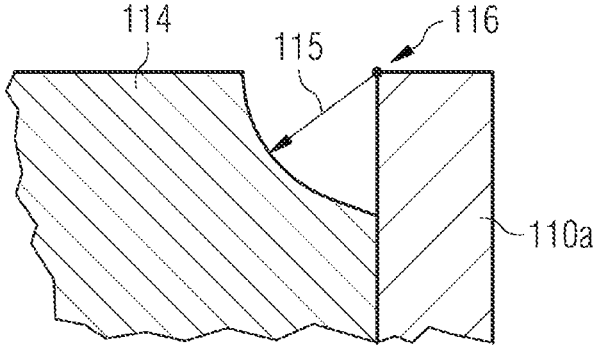
FIG. 20 is a partial view of the usable space for windings in detail.

FIG. 20 shows the usable space for windings in more detail. It is preferred, when the winding 114*a* is distant at a radius 115 from the edge 116 of any bar of soft magnetic core 110*a*.

Preferably, this radius is greater or equal than the air gap 113 (which is applicable to all other soft magnetic cores).

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

100 transformer part
101 body
102 circular groove
103 rotational axis
110 soft magnetic core
111 spacer
112 termination module
113 air gap
114 space available for winding
115 radius
116 edge of bar
120 first end the first winding
121 second end of first winding
122 first end of the second winding
123 second end of second winding
124 terminating contact
125 screw
130 base
131 center bar
132 first sidebar
133 second sidebar
134 first winding
135 second winding
136, 137 protrusions
138 fins of spacer
139 cores of base
140 hole
141-144 turns of windings
145 groove
147, 148 clamps
149 base plate
150 transformer segment body
151 winding separation bar
152 first opening for first soft magnetic cores
153 second opening for second soft magnetic cores
154, 155 opening for sidebar
156, 157 elastic elements
160 soft magnetic core
170 cover
172 first opening
173 second opening

The invention claimed is:

1. A rotating power transformer having stationary and rotating parts, at least one of the stationary and rotating parts comprising:

a body of metal or a plastic material, the body having a circular groove, rectangular cross sectioned soft magnetic cores within the groove, wedge shaped spacers between the soft magnetic cores, at least one winding in the soft magnetic cores, and a termination module configured to terminate the at least one winding.

2. The rotating power transformer of claim 1, wherein the wedge shaped spacers include a means for holding the at least one winding in place.

3. The rotating power transformer of claim 1, wherein the wedge shaped spacers include a means for holding the magnetic cores in place.

4. The rotating power transformer of claim 1, wherein a magnetic core includes an E-shaped magnetic core having a center bar, and wherein at least one clamp is fixed at the center bar to hold the magnetic core in place.

5. The rotating power transformer of claim 1, wherein the at least one winding includes wires and at least one clamp is fixed around the wires to hold the winding in place.

6. The rotating power transformer of claim 1, wherein at least one soft magnetic core is glued to (i) the body and at least one of (ii) spaces between the soft magnetic cores, neighboring soft magnetic cores, spacers, windings, and the circular grove of the body that is cast.

7. The rotating power transformer of claim 1, wherein at least one soft magnetic core has at least one hole or groove structured to fix the at least one soft magnetic core to the body.

8. The rotating power transformer of claim 1, wherein at least one soft magnetic core includes a center bar and at least one hole or groove under the center bar.

* * * * *